US007029311B2

(12) United States Patent
Peloza

(10) Patent No.: US 7,029,311 B2
(45) Date of Patent: Apr. 18, 2006

(54) LATCH FOR ELECTRICAL CONNECTORS

(75) Inventor: Kirk B. Peloza, Naperville, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/931,759

(22) Filed: Sep. 1, 2004

(65) Prior Publication Data

US 2006/0046556 A1 Mar. 2, 2006

(51) Int. Cl.
*H01R 13/627* (2006.01)

(52) U.S. Cl. ..... 439/357; 439/344; 439/923

(58) Field of Classification Search ..... 439/357, 439/358, 344, 923
See application file for complete search history.

(56) References Cited

U.S. PATENT DOCUMENTS 4,245,879 A * 1/1981 Buck ..... 439/345
4,541,036 A * 9/1985 Landries et al. ..... 361/823
5,254,014 A * 10/1993 Yagi et al. ..... 439/353
5,486,117 A * 1/1996 Chang ..... 439/357
5,562,475 A * 10/1996 Kern et al. ..... 439/344
5,713,752 A * 2/1998 Leong et al. ..... 439/358
5,971,790 A 10/1999 Rohde ..... 439/357
6,149,451 A * 11/2000 Weber ..... 439/358
6,186,819 B1 2/2001 Holub ..... 439/358
6,431,887 B1 * 8/2002 Yeomans et al. ..... 439/108
6,890,205 B1 * 5/2005 Wu ..... 439/358

* cited by examiner

*Primary Examiner*—Hae Moon Hyeon
(74) *Attorney, Agent, or Firm*—Stephen Z. Weiss

(57) ABSTRACT

A flexible latch is provided for an electrical connector and includes an elongated flexible strip having front and rear ends fixed to a connector housing, with the strip being spaced from and flexible relative to the housing between the fixed ends. The flexible strip has a body portion of a given width extending forwardly from and flexibly rotatable in a given direction about the fixed rear end. A latching portion, having a total width less than the given width, extends rearwardly from and is flexibly rotatable opposite the given direction about the front end. A generally triangularly-shaped latch hook is formed on the latching portion for movement into and out of latching engagement with the mating connecting device as the latching portion and the body portion flexibly rotate in opposite directions about the fixed front and rear ends, respectively.

16 Claims, 3 Drawing Sheets

LATCH FOR ELECTRICAL CONNECTORS

FIELD OF THE INVENTION

This invention generally relates to the art of electrical connectors and, particularly, to a flexible latch for latching an electrical connector to a mating connecting device.

BACKGROUND OF THE INVENTION

A typical electrical connector includes some form of insulating or dielectric housing which mounts a plurality of conductive terminals. The connector is mated to a complementary mating connector or other connecting device which also has terminals for connection to the terminals of the first connector. Often, there is some form of interengaging latch means between the two connectors to hold the connectors in mated condition.

The present invention is directed to improvements in flexible latches between a pair of mating electrical connecting devices.

SUMMARY OF THE INVENTION

An object, therefore, of the invention is to provide a new and improved flexible latch for electrical connectors.

In the exemplary embodiment of the invention, a flexible latch is provided for latching an electrical connector to a complementary mating connecting device. The latch includes an elongated flexible strip having front and rear ends fixed to a connector housing, with the strip being spaced from and being flexible relative to the housing between the fixed ends. The flexible strip has a body portion of a given width extending forwardly from and is flexibly rotatable in a given direction about the fixed rear end. A latching portion of a width less than the given width extends rearwardly from and is flexibly rotatable opposite the given direction about the fixed front end. A generally triangularly-shaped latch hook is formed on the latching portion for movement into and out of latching engagement with the mating connecting device as the latching portion and the body portion flexibly rotate in opposite directions about the fixed front and rear ends, respectively.

As disclosed herein, the flexible strip is stamped and formed of sheet metal material. The body is generally planar and the latch hook is located at a juncture between the latching portion and the body portion of the flexible strip.

According to one aspect of the invention, the triangularly-shaped latch hook includes a first corner joined to the latching portion, a second corner joined to the body portion and a third corner forming an apex for latching engagement with the mating connecting device. The latch hook is open between the first and second corners. The invention contemplates that the latch hook be provided with a reduced thickness at least at the apex to promote buckling thereat in the event that excessive forces are applied to the electrical connector in an unmating direction. In the preferred embodiment, at least one of the first or second corners of the triangularly-shaped latch hook also has a reduced thickness.

According to another aspect of the invention, the latching portion of the flexible strip comprises two laterally spaced generally parallel beams. Each beam includes one of the latch hooks. The latch hooks are located at junctures between the beams and the body portion of the elongated flexible strip.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
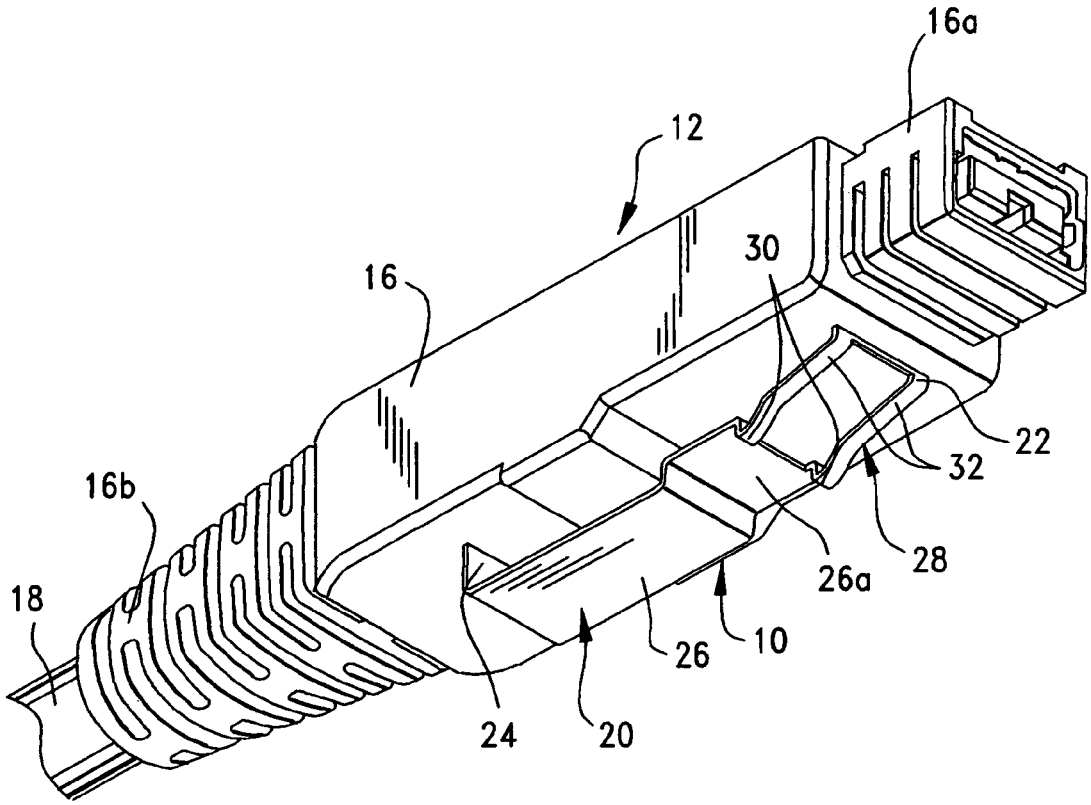
FIG. 1 is a bottom perspective view of an electrical connector incorporating the flexible latch of the invention.
Figure 2:
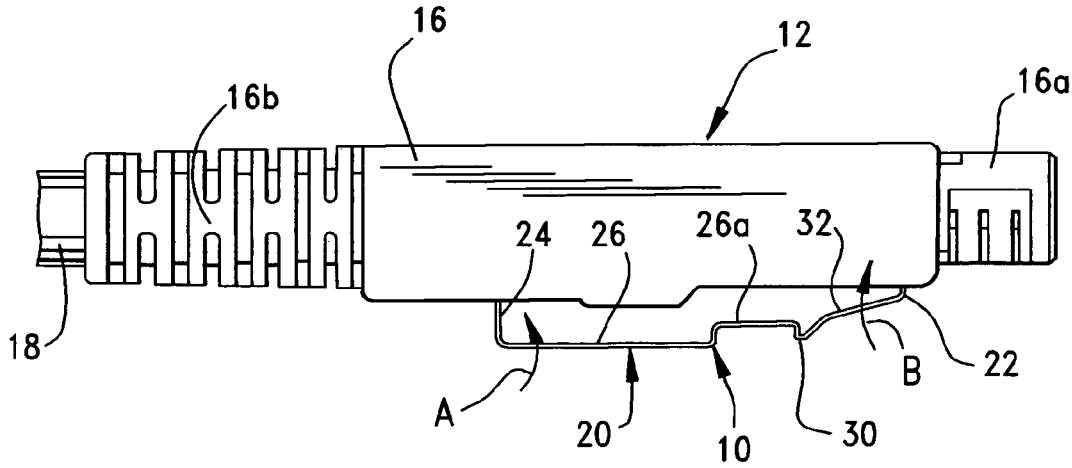
FIG. 2 is a side elevational view of the connector.
Figure 6:
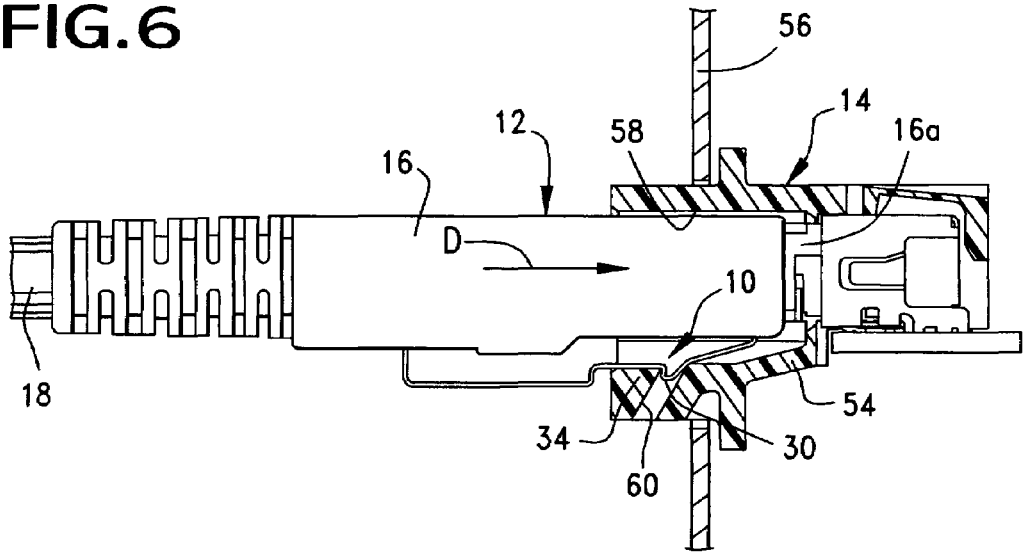
FIG. 6 shows a side elevational view of the connector mated with a complementary mating connector shown in section.

Referring to the drawings in greater detail, and first to FIGS. 1 and 2, the invention is embodied in a flexible latch, generally designated 10, for latching an electrical connector, generally designated 12, to a complementary mating connecting device, generally designated 14 in FIG. 6. Connector 12 includes a housing 16 which mounts a plurality of conductive terminals (not visible in the drawings). The housing may be molded of dielectric material such as plastic and has a mating end 16*a*. A rear end 16*b* of the housing is terminated to an electrical cable 18 which includes a plurality of conductors terminated to the terminals within housing 16. It should be understood herein that flexible latch 10 has a wide range of applications, and the term "electrical" connector herein and in the claims hereof is intended to include a variety of "conductors including electrical wires, optical fibers and the like.

With that understanding, flexible latch 10 comprises an elongated flexible strip, generally designated 20, which is stamped and formed of sheet metal material. The strip has a front end 22 and a rear end 24, and both ends 22 and 24 are rigidly fixed to connector housing 16, with strip being spaced from and flexible relative to the housing between the fixed ends. The ends may be fixed to the housing by fixing the ends in slots in the housing, or the housing may be overmolded about the front and rear ends of strip 20. A generally planar body portion 26 extends forwardly from and is flexibly rotatable in a given direction indicated by arrow "A" (FIG. 2) about rear end 24. The body portion has a front recessed end 26*a*. A latching portion, generally designated 28, has a width less than the total accumulated width of the body portion and extends rearwardly from and is flexibly rotatable about fixed front end 22 in a direction indicated by arrow "B" (FIG. 1): i.e., opposite the flexing direction "A" of body portion 26. This reduced total accumulated width will allow the front end 22 to flex more easily than the rear end 24. A triangularly-shaped latch hook 30 is formed on latching portion 28 for movement into and out of engagement with the mating connecting device, as will be seen hereinafter. As the latch hook moves into and out of engagement with the mating connecting device, latching portion 28 and body portion 26 rotate in opposite directions about fixed front and rear ends 22 and 24, respectively, as indicated by arrows "A" and "B".

Figure 3:
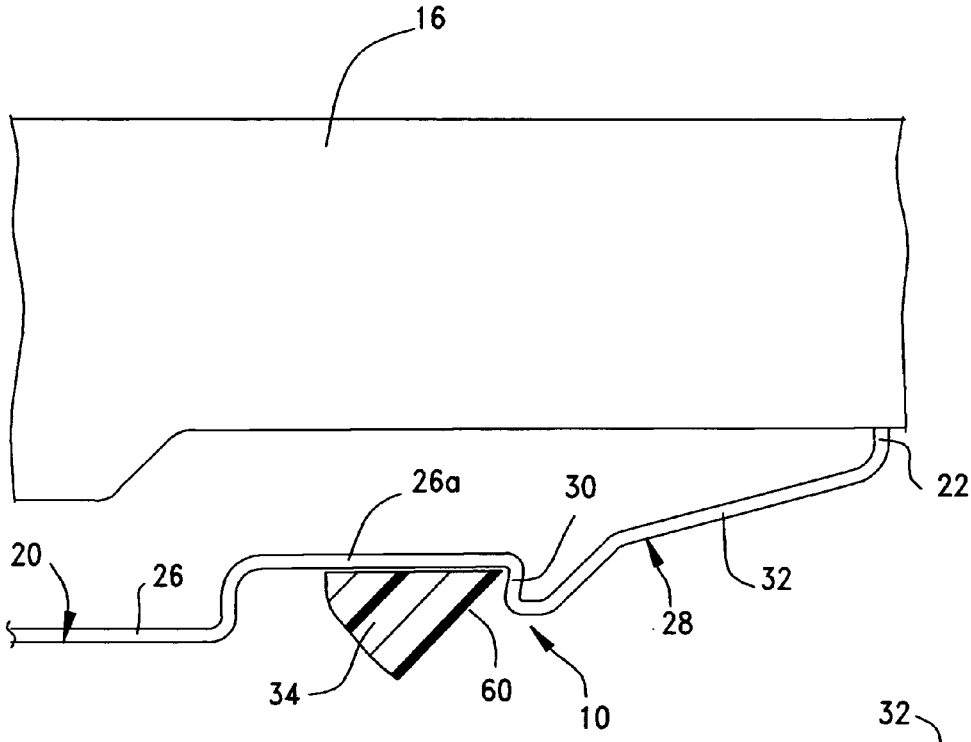
FIG. 3 is a fragmented, enlarged depiction showing the flexible latch in latching engagement with a latch portion of a complementary mating connector.

As best seen in FIG. 1, latching portion 28 is formed by two laterally spaced, generally parallel beams 32 extending between front fixed end 22 and the front recessed end 26*a* of body portion 26. Each flexible beam includes one of the latch hooks 30. FIG. 3 shows latch hook(s) 30 in engagement with a mating latch portion 34 of the mating connecting device.

Figure 4:
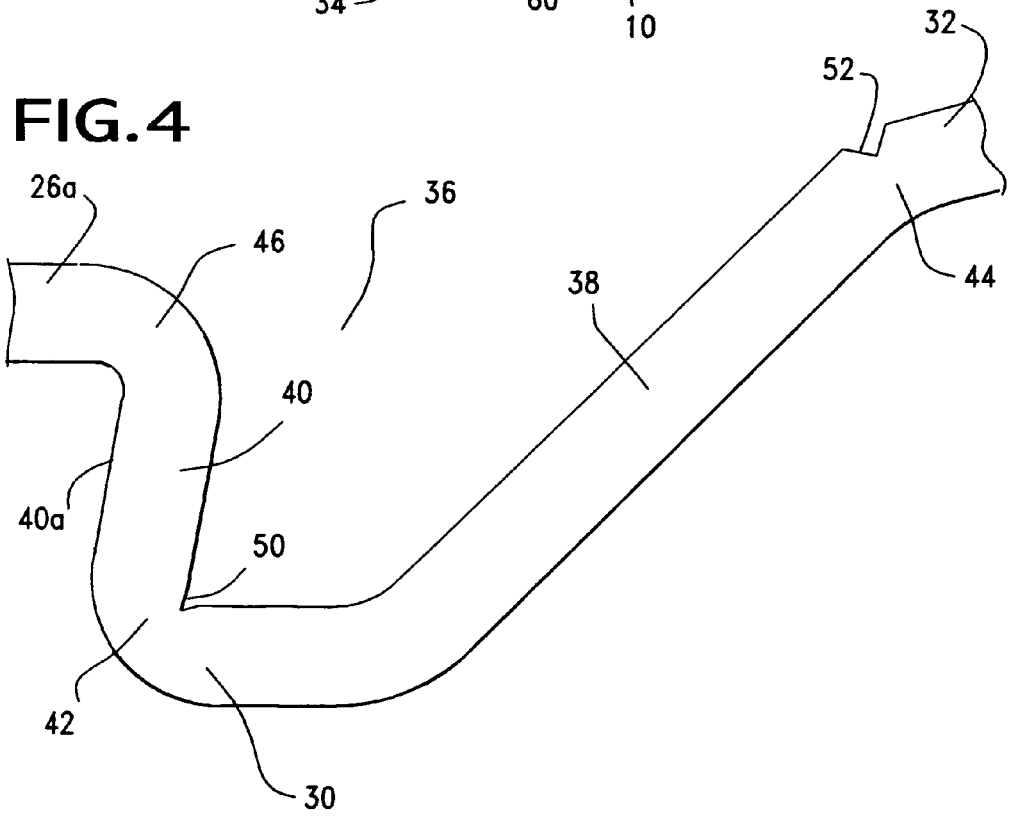
FIG. 4 is a fragmented, substantially enlarged side elevational view of the latch hook portion of the flexible latch.

FIG. 4 shows one of the triangularly-shaped latch hooks 30 in considerable detail. The latch hook has a first open side 36 between the rear of beam(s) 32 and front recessed end 26*a* of body portion 26. A second side 38 extends angularly and rearwardly from beam(s) 32 and is joined to a third side 40 at an apex 42. Third side 40 forms a latching surface 40*a* for engaging latch portion 34 of the mating connecting device, as seen in FIG. 3. In essence, with the triangularly-shaped latch hook 30 as shown in FIG. 4, second side 38 is joined to beam 32 of latching portion 28 at a first corner 44. Third side 40 is joined to body portion 26*a* at a second corner 46, and the third corner of the triangular configuration is formed by apex 42.

A feature of the invention is to design latch hook 30 to allow flexible latch 10 to collapse and release from latch portion 34 of the mating connecting device in the event that predetermined excessive forces are applied to connector 12 in an unmating direction, such as pulling on cable 18. In actual practice, mating connecting device 14 is mounted on a chassis of medical equipment to which one or more cables 18 are connected. The medical equipment is very expensive, and if pulling forces are applied to the cable, it is better for the cable (flexible latch 10) to release from the equipment than to have the equipment damaged.

To that end, and still referring to FIG. 4, apex 42 of latch hook 30 is scored, as at 50, to reduce the thickness of the material at the apex. In addition, at least one of the corners 44 or 46 (44 in the illustrated embodiment) also is scored, as at 52, to reduce the thickness of the material at this point. Therefore, latch hook(s) 30 can collapse, due to these reduced thickness points or areas of scoring, and connector 12 is released from mating connecting device 14. Scoring 50 and 52 can be formed during the stamping and forming process of metal strip 20.

Figure 5:
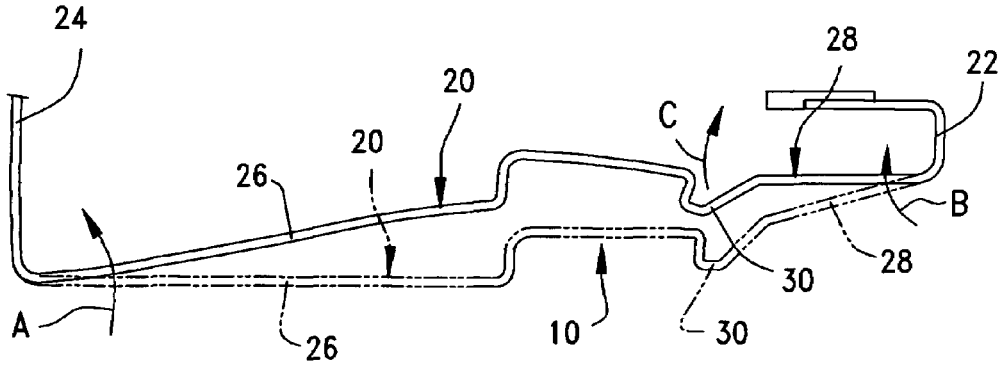
FIG. 5 shows the flexible latch in phantom in its latching position and in full lines in its release position.

FIG. 5 simply shows flexible strip 20 of flexible latch 10 in its latched position, as shown in phantom, and in its released position, as shown in full lines. It can be seen that latch hook(s) 30 move upwardly in a release direction indicated by arrow "C" as body portion 26 flexibly rotates in the direction of arrow "A" and latching portion 28 flexibly rotates in the direction of arrow "B", as described above.

FIG. 6 shows that mating connecting device 14 is a panel-mounted connector including a connector housing 54 mounted in a panel 56 which may be an outside chassis wall for various internal equipment, such as medical equipment. Housing 54 includes a receptacle 58 into which connector 12 is matingly inserted in the direction of arrow "D". It can be seen that latch hook(s) 30 latchingly engage latch portion 34 described above in relation to FIG. 3.

Figure 7:
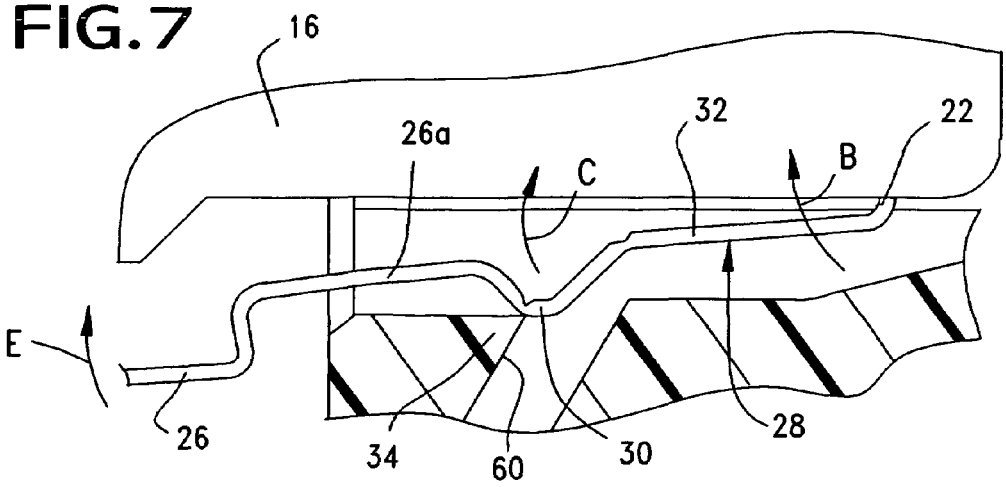
FIG. 7 is a fragmented, enlarged depiction showing the latch hook being released from the mating connector.

FIG. 7 shows latch hook(s) 30 partially collapsed due to excessive forces applied to the cable and having been moved upwardly in the direction of arrow "C" out of engagement with latch portion 34 causing the body portion 26 to move in the direction of arrow "E" as latching portion 28 flexibly rotates in the direction of arrow "B".

Finally, FIG. 7 shows a feature of mating connecting device 14 which incorporates mating latch portion 34 as one side or corner of the housing which defines a drain hole 60 in the housing. The drain hole drains out of the bottom of the housing as seen in FIG. 6. The drain hole is wide enough to latchingly engage the latch hooks of both beams 32, with the drain hole being open between the laterally spaced latch hooks. Therefore, the drain hole performs a dual function of draining moisture or other liquids from within the interior of connector housing 54, as well as providing a latching surface for mating latch portion 34 which engages latch hooks 30 of flexible latch 10.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A flexible latch for latching an electrical connector to a complementary mating connecting device, comprising:

an elongated flexible strip having front and rear ends fixed to a connector housing with the strip being spaced from and flexible relative to the housing between the front and rear ends and including, a body portion of a given width extending forwardly from and flexibly rotatable in a given direction about said rear end, a latching portion, having a consistent thickness and a total width less than said given width, extending rearwardly from and flexibly rotatable opposite said given direction about said front end, and a generally triangularly-shaped latch hook on the latching portion for movement into and out of latching engagement with the mating connecting device as the body portion and the latching portion flexibly rotate in opposite directions about said front and rear ends, respectively, the triangularly-shaped latch hook including a first corner joined to the latching portion, a second corner joined to the body portion and a third corner forming an apex for latching engagement with the mating connecting device, the apex having a reduced thickness to promote buckling thereat in the event that excessive forces are applied to the electrical connector in an unmating direction.

2. The flexible latch of claim 1 wherein said flexible strip is stamped and formed of sheet metal material.

3. The flexible latch of claim 1 wherein said latch hook is located at a juncture between the latching portion and the body portion of the flexible strip.

4. The flexible latch of claim 1 wherein said body portion is generally planar.

5. The flexible latch of claim 1 wherein at least one of the first or second corners of said triangularly-shaped latch hook also has a reduced thickness.

6. The flexible latch of claim 1 wherein said triangularly-shaped latch hook includes a first open side between the latching portion and the body portion, and second and third sides respectively joined at adjacent ends thereof to each other to form an apex for latching engagement with the mating connecting device.

7. The flexible latch of claim 1 wherein said latching portion comprises two laterally spaced, generally parallel beams each including one of said latch hooks.

8. The flexible latch of claim 7 wherein said latch hooks are located at junctures between the beams and the body portion of the elongated flexible strip.

9. A flexible latch for latching an electrical connector to a complementary mating connecting device, comprising:

an elongated flexible strip stamped and formed of sheet metal material and having front and rear ends fixed to a connector housing with the strip being spaced from and flexible relative to the housing between the front and rear ends and including, a generally planar body portion of a given width extending forwardly from and flexibly rotatable in a given direction about said rear end, a latching portion, having a consistent thickness and a total width less than said given width, extending rearwardly from and flexibly rotatable opposite said given direction about said front end, and a generally triangularly-shaped latch hook located at a juncture between the latching portion and the body portion of the flexible strip for movement into and out of latching engagement with the mating connecting device as the body portion and the latching portion flexibly rotate in opposite directions about said front and rear ends, respectively, the latch hook including a first corner joined to the latching portion, a second corner joined to the body portion and a third corner forming an apex for latching engagement with the mating connecting device, the apex having a reduced thickness to promote buckling thereat in the event that excessive forces are applied to the electrical connector in an unmating direction.

10. The flexible latch of claim 9 wherein at least one of the first or second corners of said triangularly-shaped latch hook also has a reduced thickness.

11. The flexible latch of claim 9 wherein said latching portion comprises two laterally spaced, generally parallel beams each including one of said latch hooks.

12. The flexible latch of claim 11 wherein said latch hooks are located at junctures between the beams and the body portion of the elongated flexible strip.

13. A flexible latch for latching an electrical connector to a complementary mating connecting device, comprising:

an elongated flexible strip having front and rear ends fixed to a connector housing with the strip being spaced from and flexible relative to the housing between the front and rear ends and including, a body portion of a given width extending forwardly from and flexibly rotatable in a given direction about said rear end, a latching portion comprising at least two laterally spaced, generally parallel beams having a consistent thickness and a total width less than said given width and extending rearwardly from and flexibly rotatable opposite said given direction about said front end, and a latch hook on each beam for movement into and out of latching engagement with the mating connecting device as the body portion and the latching portion flexibly rotate in opposite directions about said front and rear ends, respectively, the latch hooks being generally triangular and including a first corner joined to the latching portion, a second corner joined to the body portion and a third corner forming an apex for latching engagement with the mating connecting device, the apex having a reduced thickness to promote buckling thereat in the event that excessive forces are applied to the electrical connector in an unmating direction.

14. The flexible latch of claim 13 wherein said latch hooks are located at junctures between the beams and the body portion of the elongated flexible strip.

15. The flexible latch of claim 13 wherein at least one of the first or second corners of each triangularly-shaped latch hook also has a reduced thickness.

16. A flexible latch for latching an electrical connector to a complementary mating connecting device, comprising:

an elongated flexible strip having a consistent thickness and at least one end fixed to a connector housing, with the strip being spaced from and flexible relative to the housing and including;

a body portion flexible about said at least one fixed end, and a triangularly shaped latch hook coupled to the body portion for movement into and out of latching engagement with the mating connecting device, the latch hook having an apex with a reduced thickness formed thereat to promote buckling thereat in the event that excessive forces are applied to the electrical connector in an unmating direction.

* * * * *